United States Patent [19]

Furukawa et al.

[11] 4,437,903

[45] Mar. 20, 1984

[54] METHOD FOR PRODUCING TWO-PHASE HOT ROLLED STEEL SHEET HAVING HIGH STRENGTH AND LOW YIELD RATIO

[75] Inventors: Takashi Furukawa; Michio Endo, both of Kanagawa, Japan

[73] Assignee: Nippon Steel Corporation, Tokyo, Japan

[21] Appl. No.: 459,145

[22] Filed: Jan. 19, 1983

[30] Foreign Application Priority Data

Jan. 28, 1982 [JP] Japan ..... 57-12277

[51] Int. Cl.[3] ..... C21D 8/04

[52] U.S. Cl. ..... 148/12 F; 148/12.4

[58] Field of Search ..... 75/123 B; 148/12 C, 148/12 F, 12.4, 12.3, 36

[56] References Cited

U.S. PATENT DOCUMENTS

| | | | |
|---|---|---|---|
| 4,188,241 | 2/1980 | Watanabe et al. | 148/12.3 |
| 4,316,753 | 2/1982 | Kaneko et al. | 148/12 F |

FOREIGN PATENT DOCUMENTS

| | | | |
|---|---|---|---|
| 55-44551 | 3/1980 | Japan | 148/12 F |
| 55-104429 | 8/1980 | Japan | 148/12 F |
| 56-72127 | 6/1981 | Japan | 148/12.4 |

*Primary Examiner*—Peter K. Skiff

*Attorney, Agent, or Firm*—Cushman, Darby & Cushman

[57] ABSTRACT

A method for producing two-phase steel sheets having a material quality equal to or better than the conventional two-phase steel sheets by an addition of a very small amount of B so as to considerably reduce the contents of steel constituents, such as Mn and Si, thus eliminating the problems concerning the production cost, descaling in the processing and material quality in the ultimate applications.

5 Claims, 1 Drawing Figure

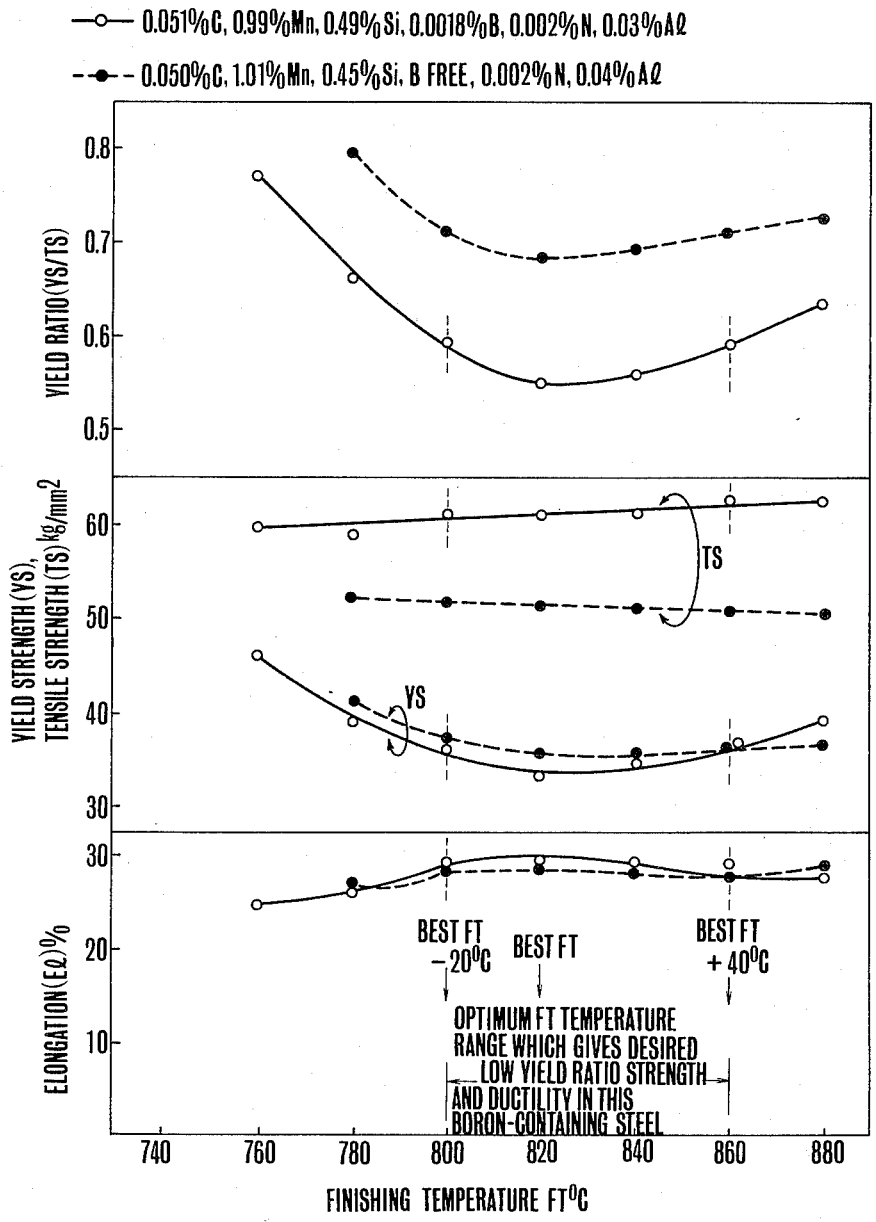
0.051%C, 0.99%Mn, 0.49%Si, 0.0018%B, 0.002%N, 0.03%Aℓ
0.050%C, 1.01%Mn, 0.45%Si, B FREE, 0.002%N, 0.04%Aℓ
YIELD RATIO (YS/TS)
0.8
0.7
0.6
0.5
YIELD STRENGTH (YS), TENSILE STRENGTH (TS) kg/mm²
60
50
40
30
TS
YS
ELONGATION (Eℓ) %
30
20
10
BEST FT −20°C
BEST FT
BEST FT +40°C
OPTIMUM FT TEMPERATURE RANGE WHICH GIVES DESIRED LOW YIELD RATIO STRENGTH AND DUCTILITY IN THIS BORON-CONTAINING STEEL
740
760
780
800
820
840
860
880
FINISHING TEMPERATURE FT°C

METHOD FOR PRODUCING TWO-PHASE HOT ROLLED STEEL SHEET HAVING HIGH STRENGTH AND LOW YIELD RATIO

BACKGROUND OF THE INVENTION

FIELD OF THE INVENTION

This invention relates to a method for producing two-phase, high strength, hot rolled steel sheet having excellent workability. Coild steel strips as well as cut steel sheets are collectively referred to herein as "sheet". "Low yield ratio" used herein means that $$\frac{\text{yield strength } (YS)}{\text{tensile strength } (TS)} \leqq 0.6$$

and the term "two-phase" or "two-phase structure" used herein means a steel structure which is composed essentially of the ferrite phase and the rapidly cooled transformation phase (containing mainly martensite with some amount of bainite and residual austenite).

In recent years, two-phase steel sheets with a low yield ratio have been increasingly adopted as press-forming steel materials in the automobile industry because of their excellent strength-ductility relationship, and in the field of hot rolling art for production of such two-phase steel sheets a method has been proposed (for example, Japanese Patent Publication No. Sho 55-49135, Japanese Laid-Open Patent Application No. Sho 56-29624, etc.), which comprises a low-temperature finishing and an extremely low temperature (lower than about 300° C.) cooling. Therefore, it may be said the technical art in this field has been almost established.

However, in the prior art, it is generally necessary to add not less than 1.3% Mn to the steel, or if the manganese content is as low as 1.1% to 1.3%, for example, it is necessary to add at least 1% Si to the steel in order to obtain steel sheets having tensile strength of about 60 kg/mm$^2$ so that the production cost is inevitably increased or some problems are unavoidable with respect to the descaling of the resultant hot rolled sheets or the paint adhesion of sheets in their ultimate applications.

SUMMARY OF THE INVENTION

Therefore, one of the objects of the present invention is to provide a process for producing two-phase steel sheets having a material quality equal to or better than the conventional two-phase steel sheets by an addition of a very small amount of B so as to considerably reduce the contents of steel constituents, such as Mn and Si, thus eliminating the problems just mentioned above concerning the production cost, descaling in the processing and material quality in the ultimate applications.

It is conventionally known that the hardenability of steels can be improved by addition of B, and in the case of hardening from the austenite single phase, the amount of elements required for obtaining the same level of strength can be reduced.

However, there is no prior knowledge or art which teaches boron addition and manufacturing factors in terms of production of a material having a low yield ratio and an improved ductility under a tandem-mill hot rolling condition as in the present invention, because while the two-phase steel sheet can be obtained by rapid cooling from the temperature range in which both ferrite and austenite phases coexist, neither has ever been known how the two-phase coexisting state of boron-containing steels will be brought about under a tandem-mill hot rolling finishing condition, nor has ever been known about the effect of B on the austenite hardening from such two-phase coexisting state.

One prior art, Japanese Laid-Open Patent Application No. Sho 55-91934 merely mentions addition of boron but discloses no embodiments containing B and makes no reference to restriction of the nitrogen content.

Also this prior art discloses preferable manganese contents not less than 1.3%. Thus, this prior art teaches or suggests nothing of necessity of restriction of the nitrogen content, which is essential in the present invention, and nothing of possibility of remarkable reduction of the manganese content (0.7%–1.3%) as realized for the first time by the present invention.

It has been found by the present inventors that the finishing temperature in the hot rolling is particularly important. Finishing condition for obtaining the desired low yield ratio and ductility in connection with the steel composition as defined in the present invention, hence the range of finishing temperature, is remarkably restricted as compared with that of C-Mn-Si steel compositions and the like as disclosed in Japanese Laid-Open Patent Application No. Sho 56-29624. It has been found by the present inventors that when the steels contain a small amount of B as a steel constituent the desired finishing temperature (hereinafter called "FT") will be in accordance with a certain rule in relation with the contents of C, Mn and Si, and it has been further found that when the steel compositions as defined in the present invention are hot rolled with this finishing temperature FT, rapidly cooled and coiled at an extremely lower coiling temperature than usual, it is possible to obtain a two-phase, high strength steel sheet having excellent workability and low yield ratio.

The process according to the present invention comprises:

hot rolling a steel containing
- 0.03%–0.12% C
- 0.7%–1.3% Mn
- 0.01%–0.9% Si
- 0.01%–0.1% Al
- 0.0005%–0.005% B
- not more than 0.006% N with a finishing temperature FT with a temperature range defined by $$FT\,(°\text{C.}) = 953 - 400 \times (\text{C }\%) - 133 \times (\text{Mn }\%) + 40 \times (\text{Si }\%)^{+40}_{-20}$$

and cooling the hot rolled steel sheet thus obtained to a temperature not higher than 300° C. with an average cooling rate of 20° to 200° C./second.

Various limitations with respect to the elements and process conditions as defined in the present invention will be explained hereinbelow.

Carbon, if present in amounts less than 0.03%, cannot produce a desired tensile strength, and if present in amounts exceeding 0.12%, makes it very difficult to separate the ferrite phase from the austenite phase at the time of completion of the hot rolling finishing and makes it practically impossible to obtain a two-phase structure rich in soft ferrite phase. Therefore, the carbon content is limited to the range of $0.03\% \leqq C \leqq 0.12\%$ in the present invention.

Manganese, when present in amounts less than 0.7%, cannot provide a sufficient martensite phase, but on the other hand, when it is present in amounts in excess of 1.3%, there is a strong tendency that the steel structure is wholly transformed into martensite. Therefore, in the present invention, the manganese content is limited to the range of $0.7\% \leqq Mn \leqq 1.3\%$. The manganese content range such as $0.7\% \leqq Mn \leqq 1.0\%$ is recommended from the viewpoint of weldability, since a high manganese content may be hazardous to weldability.

Silicon is an element which is advantageous to improving the ductility, but is adverse to the descaling property and the paint adhesion, and in the present invention a compromise between the advantage and adversity leads to the range of $0.01\% \leqq Si \leqq 0.9\%$.

Boron in amounts less than 0.0005% scarcely contributes for increasing the tensile strength and lowering the yield ratio (based on the promotion of martensite formation), but boron contents exceeding 0.005%, its desired effects saturate and the resultant ductility deteriorates.

Therefore, in the present invention, the boron content is limited to the range of $0.0005\% \leqq B \leqq 0.005\%$.

Nitrogen, when present in excessive amounts, combines with boron to form boron nitride, thus nullifying the desired effects of boron. Therefore, the nitrogen content should be maintained in amounts not more than 0.006%.

Sulphur should be limited to be $S \leqq 0.01\%$, to minimize the amount of sulphide inclusion so that bendability of the sheet may not be deteriorated.

Phosphorus should also be limited to be $P \leqq 0.02\%$, in order to secure elongation and weldability of the sheet.

The finishing temperature FT has been defined in view of the following facts.

When the temperature FT is outside the range defined by the formula set forth hereinbefore, the yield increases and the ductility lowers. The formula is an experimental formula obtained through the embodiments of the present invention.

As clearly understood from the formula, the temperature zone in which the FT temperature can change covers 60 degrees C., which is considerably limited as compared with the temperature zone of about 100 degrees C. permitted in steels containing no boron as disclosed in the prior art, Japanese Laid-Open Patent Application No. Sho 56-29624. This is mainly due to the fact that the temperature zone which can provide a desired structure in which the ferrite and the austenite are present in a separate state is markedly narrowed by boron addition.

Regarding the cooling rate after the finishing, the martensite is not formed if the cooling rate is less than 20° C./second, but the ductility lowers if it is larger than 200° C./second.

Also, if the coiling temperature is higher than 300° C., the desired martensite phase cannot develop.

According to the most preferable embodiment of the present invention, a steel composition containing 0.04% to 0.09% carbon, 0.7% to 1.0% Mn, 0.2% to 0.7% Si, less than 0.004% N, 0.001% to 0.004% B is continuously hot rolled in such a manner that the finishing temperature will be in accordance with the formula for FT, then rapidly cooled, and coiled at a temperature not higher than 200° C. In this way, a low yield-ratio steel sheet with tensile strength ranging from 50 to 60 $kg/mm^2$ can be obtained. According to the prior art, as disclosed by Japanese Laid-Open Patent Application No. Sho 56-29624, it is necessary to use a higher alloy steel to obtain a steel sheet of 60 $kg/mm^2$ grade in tensile strength, and it is very difficult, though not impossible, to obtain a steel sheet which shows a sufficiently low yield ratio and yet has tensile strength of 50 $kg/mm^2$ grade.

BRIEF EXPLANATION OF THE DRAWING

The accompanying drawing shows the relation between the finishing temperature FT of hot rolling and mechanical properties of a boron-containing steel and a boron-free steel.

DESCRIPTION OF PREFERRED EMBODIMENTS

The present invention will be better understood from the following description of preferred embodiments with reference to the accompanying drawing, but it should be understood that the present invention is not limited to those embodiments.

EXAMPLE 1

A steel slab of 25 mm in thickness, containing 0.051% C, 0.99% Mn, 0.49% Si, 0.007% P, 0.006% S, 0.03% Al, 0.0018% B, and 0.002% N, and a comparative boron-free steel slab of the same thickness, containing 0.050% C, 1.01% Mn, 0.45% Si, 0.006% P, 0.005% S, 0.04% Al and 0.002% N were soaked at 1100° C. for one hour, and hot rolled to 14 mm thick by the first pass at 1030° C. to 5.6 mm thick by the second pass at 950° C., and to 4.0 mm thick by the third pass so as to assure the sheet temperature immediately after the completion of the third pass varies within the temperature range of from 700° C. to 900° C., then the hot rolled sheets thus obtained were cooled to 150° C. with an average cooling rate of 50° C./second, and slowly cooled with a cooling rate of 20° C./hour (this is a similation test for the coiling at 150° C.). The results of the tensile tests of the sheets are shown in the drawing. It is clearly understood from the drawing, that the steel composition containing 0.05% C, 1% Mn and 0.5% Si cannot provide a substantially low yield ratio without addition of boron and that the addition of boron to a similar steel composition can provide a remarkable lowering of yield ratio and a substantial increase of strength without adverse effects on the ductility. The FT temperature which ensures the lowest yield ratio, namely the best FT temperature, for the above steel composition is 820° C. and the temperature range which can produce the desired low yield ratio ($YS/TS \leqq 0.6$) is from (best FT −20° C.) to (best FT +40° C.).

EXAMPLE 2

Various steels shown in Table 1 were subjected to continuous hot rolling experiments under similar conditions to those in Example 1 and the results are shown in Table 2.

In Table 2, the results obtained with the best finishing temperatures are shown, but the relationship between the mechanical properties and the finishing temperatures for each steel is similar to that shown in the drawing, and the optimum temperature range which can produce the desired yield ratio is from (best FT −20° C.) to (best FT +40° C.).

From the steel compositions shown in Table 1 and the results at the best finishing temperatures shown in Table 2 the following experimental formula which defines the relation between the finishing temperature and the steel composition.

Best $$FT(°C.)=953-400\times(C\%)-133\times(Mn\%)+40\times(Si\%)$$

In order to control the shape of non-metallic inclusions and hence to improve properties such as the bending property and the flange stretchability, it is recommendable to add Ca or rare earth elements (REM) to the steel composition depending on the contents of S present as impurity, in such amounts as Ca%/S%>3 or REM%/S%>5.

TABLE 1

| | Steel Composition (wt. %) | | | | | | | |
|---|---|---|---|---|---|---|---|---|
| No. | C | Mn | Si | Al | P | S | N | B |
| 1 | 0.081 | 0.70 | 0.51 | 0.04 | 0.006 | 0.007 | 0.003 | 0.0028 |
| 2 | 0.051 | 1.00 | 0.01 | 0.04 | 0.005 | 0.006 | 0.002 | 0.0023 |
| 3 | 0.062 | 0.98 | 0.03 | 0.04 | 0.007 | 0.004 | 0.004 | 0.0031 |
| 4 | 0.080 | 0.97 | 0.02 | 0.05 | 0.006 | 0.005 | 0.003 | 0.0025 |
| 5 | 0.075 | 0.95 | 0.62 | 0.04 | 0.005 | 0.006 | 0.002 | 0.0020 |
| 6 | 0.10 | 0.98 | 0.01 | 0.03 | 0.008 | 0.004 | 0.002 | 0.0019 |
| 7 | 0.11 | 1.25 | 0.02 | 0.05 | 0.005 | 0.004 | 0.002 | 0.0016 |

TABLE 2

| | | Best Finishing Temperatures and Mechanical Properties | | | | | | |
|---|---|---|---|---|---|---|---|---|
| No. | Steel Thickness (mm) | Best FT (°C.) | Cooling Rate (°C./sec.) | Coiling Temp. (°C.) | Yield Strength (kg/mm²) | Tensile Strength (kg/mm²) | Yield Ratio (YS/TS) | Elongation (%) |
| 1 | 4.0 | 850 | 50 | 150 | 35.2 | 61.8 | 0.57 | 29.1 |
| 2 | 4.0 | 800 | 50 | 150 | 30.2 | 52.1 | 0.58 | 32.8 |
| 3 | 4.0 | 800 | 50 | 200 | 30.5 | 52.5 | 0.58 | 32.3 |
| 4 | 3.8 | 790 | 59 | 200 | 33.4 | 64.3 | 0.52 | 27.5 |
| 5 | 3.6 | 820 | 68 | 200 | 36.8 | 70.8 | 0.52 | 25.6 |
| 6 | 4.0 | 780 | 50 | 150 | 36.4 | 66.2 | 0.55 | 27.0 |
| 7 | 4.3 | 740 | 43 | 150 | 42.6 | 77.5 | 0.55 | 22.8 |

What we claim:

1. A method for producing high-strength, low yield ratio two-phase hot rolled steel sheets having a tensile strength of at least about 52 kg/mm² which comprises:

hot rolling a steel composition comprising:

0.03%–0.12% C 0.7%–1.0% Mn 0.01%–0.9% Si 0.01%–0.1% Al 0.0005%–0.005% B less than 0.006% N and which is about equal to the B content with a finishing temperature FT as defined by the formula:

$$FT\,(°C.) = 953 - 400 \times (C\,\%) - 133 \times (Mn\,\%) + 40 \times (Si\,\%)^{+40}_{-20}$$

(by weight %)

cooling the hot rolled sheet thus obtained to a temperature not higher than 300° C. with an average cooling rate of 20° to 200° C./second and coiling the steel sheet thus cooled.

2. A method according to claim 1, in which the sulphur and phosphorus contents of the steel are limited to the ranges of: S≦0.01% and P≦0.02%.

3. A method according to claim 1 wherein the nitrogen content is between 0.002% and 0.004% and the boron content is between 0.0016% and 0.0031%.

4. A method according to claim 3 wherein the difference between the nitrogen content and the boron content is not greater than 0.0009%.

5. A method according to claim 3 wherein the nitrogen content is 0.002% and the boron content is 0.0018%.

* * * * *